US007802578B2

(12) United States Patent
Yamada et al.

(10) Patent No.: US 7,802,578 B2
(45) Date of Patent: Sep. 28, 2010

(54) SHREDDED TOBACCO SUPPLY DEVICE FOR A CIGARETTE MANUFACTURING MACHINE

(75) Inventors: Manabu Yamada, Tokyo (JP); Takeshi Bandai, Tokyo (JP); Fujio Fukamizu, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 879 days.

(21) Appl. No.: 10/566,971

(22) PCT Filed: Aug. 4, 2003

(86) PCT No.: PCT/JP03/09873

§ 371 (c)(1),
(2), (4) Date: Mar. 2, 2007

(87) PCT Pub. No.: WO2005/011412

PCT Pub. Date: Feb. 10, 2005

(65) Prior Publication Data

US 2007/0240727 A1 Oct. 18, 2007

(51) Int. Cl.
*A24B 7/14* (2006.01)

(52) U.S. Cl. ..... 131/110; 131/84.3; 131/109.2

(58) Field of Classification Search ..... None
See application file for complete search history.

(56) References Cited

U.S. PATENT DOCUMENTS

| | | | | |
|---|---|---|---|---|
| 5,148,816 | A | 9/1992 | Heitmann | |
| 5,645,086 | A * | 7/1997 | Brand et al. | 131/84.3 |
| 6,782,890 | B2 * | 8/2004 | Barkmann et al. | 131/110 |
| 2005/0178397 | A1 * | 8/2005 | Herburg | 131/110 |

FOREIGN PATENT DOCUMENTS

| | | | |
|---|---|---|---|
| JP | 3-168077 | A | 7/1991 |
| JP | 8-256750 | A | 10/1996 |
| JP | 2000-60522 | A | 2/2000 |

* cited by examiner

*Primary Examiner*—Philip C Tucker
*Assistant Examiner*—Michael J Felton
(74) *Attorney, Agent, or Firm*—Birch, Stewart, Kolasch & Birch, LLP

(57) ABSTRACT

A shredded tobacco supply device for a cigarette manufacturing machine includes a separation throat (20) diverging from a gravity chute (18) through which shredded tobacco is let fall down, and an extension (68) extending from the outlet (20*b*) of the separation throat (20) and forming an air confluent nozzle (69) in cooperation with the trough bottom (38) of a fluid bed trough (36). The air confluent nozzle (69) produces a transport flow by joining together primary and secondary air jets $J_1$ and $J_2$ used for winnowing the shredded tobacco, and the transport flow causes a shred mixture obtained by the winnowing to be conveyed along a conveyance surface (38) toward a tobacco band.

9 Claims, 5 Drawing Sheets

SHREDDED TOBACCO SUPPLY DEVICE FOR A CIGARETTE MANUFACTURING MACHINE

TECHNICAL FIELD

The present invention relates to a supply device incorporated in a cigarette manufacturing machine as part thereof for supplying shredded tobacco to a tobacco band of the manufacturing machine.

BACKGROUND ART

A supply device of this type is adapted to feed shredded tobacco to the tobacco band. In the process of feeding, the shredded tobacco is air-classified (winnowed) according to weight, to remove heavy tobacco shreds (midribs of tobacco leaves) from a shredded tobacco supply path. As a result, only the tobacco shreds of desired sizes are supplied to the tobacco band.

The shredded tobacco thus subjected to the winnowing can be satisfactorily attracted to the tobacco band by suction, and accordingly, subsequent processes, such as the transfer of the shredded tobacco from the tobacco band onto a wrapper web and the wrapping of the shredded tobacco in the wrapper web, namely, the formation of a tobacco rod, can be stably carried out.

Thus, the process of winnowing shredded tobacco is indispensable for the cigarette manufacturing machine. The following explains the winnowing process in detail.

First, in the process of feeding shredded tobacco, air jets emitted from primary and secondary separators are sequentially blown against the shredded tobacco. The air jets serve to classify the tobacco shreds according to their weights, so that only the tobacco shreds whose weights fall within a predetermined range are introduced into a fluid bed trough. Subsequently, the shredded tobacco is conveyed along the fluid bed trough by air jets emitted from multiple stages of accelerators up to the tobacco band, where the shredded tobacco is attracted to the tobacco band by suction.

The air jets emitted from the primary and secondary separators are used only for winnowing the shredded tobacco and do not substantially contribute to the conveyance of the shredded tobacco along the fluid bed trough. Thus, in order to convey the shredded tobacco introduced into the fluid bed trough up to the tobacco band without fail, it is necessary to use the aforementioned multiple stages of accelerators, namely, the air jets emitted from these accelerators.

In this manner, the shredded tobacco supply device requires not only the primary and secondary separators but also the multiple stages of accelerators and thus consumes much energy, entailing an increased environmental load.

An object of the present invention is therefore to provide a shredded tobacco supply device which permits the air jets from accelerators to be weakened or permits the accelerators to be omitted, thereby effectively reducing the consumption of energy.

DISCLOSURE OF THE INVENTION

To achieve the object, the present invention provides a shredded tobacco supply device for a cigarette manufacturing machine, which comprises: a gravity chute through which shredded tobacco supplied thereto is let fall down, the gravity chute having a lower end for discharging the falling shredded tobacco therefrom; a separation throat diverging sideways from an intermediate portion of the gravity chute and having an inlet opening into the gravity chute and an outlet spaced apart from the inlet in the diverging direction; a primary separator for separating the shredded tobacco falling down through the gravity chute into light shreds which are introduced into the separation throat, and heavy shreds which are allowed to fall down through the gravity chute, in accordance with weights of the shreds, the primary separator producing a primary air jet traversing an interior of the gravity chute and directed toward the inlet of the separation throat; a fluid bed trough extending from the outlet of the separation throat to a tobacco band of the cigarette manufacturing machine, the fluid bed trough having a conveyance surface for guiding the light shreds delivered from the outlet of the separation throat toward the tobacco band; a separation duct extending downward from the conveyance surface, the separation duct having an open end opening in the conveyance surface in the vicinity of the outlet of the separation throat and directed toward the tobacco band, and a reception opening formed at an intermediate position thereof, the reception opening being connected to the lower end of the gravity chute for receiving the heavy shreds from the gravity chute into the separation duct; a secondary separator for separating the heavy shreds received by the separation duct into recovery shreds which are lifted upward through the separation duct and delivered onto the conveyance surface of the fluid bed trough, and reject shreds which are allowed to fall down through the separation duct, in accordance with weights of the heavy shreds, the secondary separator emitting a secondary air jet from a position of the separation duct upward of the reception opening, the secondary air jet being directed toward the open end and creating a rising current within the separation duct for lifting the recovery shreds upward; and an air confluent nozzle extending from the outlet of the separation throat, the air confluent nozzle having a cross-sectional flow area gradually decreasing with distance from the outlet of the separation throat toward the tobacco band and producing a transport flow by joining together the primary air jet from the outlet of the separation throat and the secondary air jet from the open end of the separation duct, the transport flow causing a shred mixture of the light shreds delivered from the outlet of the separation throat and the recovery shreds delivered from the open end of the separation duct to be conveyed along the conveyance surface of the fluid bed trough toward the tobacco band.

In the above supply device, the primary and secondary air jets used for separating the shredded tobacco are joined inside the air confluent nozzle to produce the transport flow. The cross-sectional flow area of the air confluent nozzle gradually decreases toward the tobacco band, and accordingly, the transport flow is accelerated within the air confluent nozzle and conveys the shred mixture delivered onto the conveyance surface of the fluid bed trough toward the tobacco band along the conveyance surface.

Namely, the primary and secondary air jets are used not only for primarily and secondarily winnowing the shredded tobacco but for conveying the shred mixture. It is therefore possible to reduce the flow velocity and flow rate of air jets that need to be emitted from accelerators for conveying the shred mixture, and thus, to lessen the consumption of energy needed to operate the accelerators.

By reducing the flow rate of the air jets from the accelerators, it is possible to keep the flavor and aroma of the shred mixture, namely, the shredded tobacco.

Alternatively, the flow velocity and flow rate of the air jets from the accelerators may be left unchanged, and in this case, the shredded tobacco conveyance capability can be significantly improved without entailing increase in the energy consumption.

Further, by increasing the flow velocity and flow rate of the air jets from the primary and secondary separators, it is possible to convey the shred mixture up to the tobacco band solely by the transport flow produced inside the air confluent nozzle. In this case, the accelerators are unnecessary, and thus, the energy consumption does not increase even though the flow velocity and flow rate of the primary and secondary air jets are increased.

Specifically, the air confluent nozzle has an extension member extending from an upper edge of the outlet of the separation throat, and the extension member forms the air confluent nozzle in cooperation with the conveyance surface of the fluid bed trough. Thus, the air confluent nozzle can be formed with ease.

Further, the separation throat has a ceiling wall and a bottom surface adjoining the conveyance surface, and the extension member extends smoothly from the ceiling wall. Specifically, the extension member and the ceiling wall extend straight along a direction in which the primary air jet is emitted, or the extension member and the ceiling wall are curved in downwardly convex form.

With this arrangement, the extension member can smoothly guide the primary air jet blowing from the outlet of the separation throat, permitting the primary air jet and the secondary air jet blowing from the open end of the separation duct to join in layers. Consequently, the transport flow produced from the primary and secondary air jets also forms a smooth laminar flow and thus can stably convey the shred mixture on the conveyance surface toward the tobacco band without stirring up the shred mixture.

Specifically, the air confluent nozzle has a nozzle outlet at a distal end of the extension member, and the nozzle outlet has a height of 10 to 20 mm from the conveyance surface. In this case, the air confluent nozzle forms no great resistance to the conveyance of the shred mixture, permitting the shred mixture to be stably accelerated while maintaining its layer form.

The supply device may further comprise a plurality of accelerators for accelerating the conveyance of the shred mixture on the conveyance surface toward the tobacco band, the accelerators being arranged at intervals in the direction of conveyance of the shred mixture and each adapted to emit an air jet toward the tobacco band. The accelerators serve to further stabilize the conveyance of the shred mixture.

Preferably, the most upstream one of the accelerators as viewed in the direction of conveyance of the shred mixture is located inside the air confluent nozzle. In this case, the air jet emitted from the most upstream accelerator also contributes to the production of the transport flow.

Further, the supply device of the present invention is also applicable to a double track type cigarette manufacturing machine. In this case, the conveyance surface of the fluid bed trough is divided into first and second trough sections on the downstream side of the air confluent nozzle, and the first and second trough sections are adapted to supply the shred mixture to respective tobacco bands of the manufacturing machine.

BEST MODE OF CARRYING OUT THE INVENTION

Figure 1:
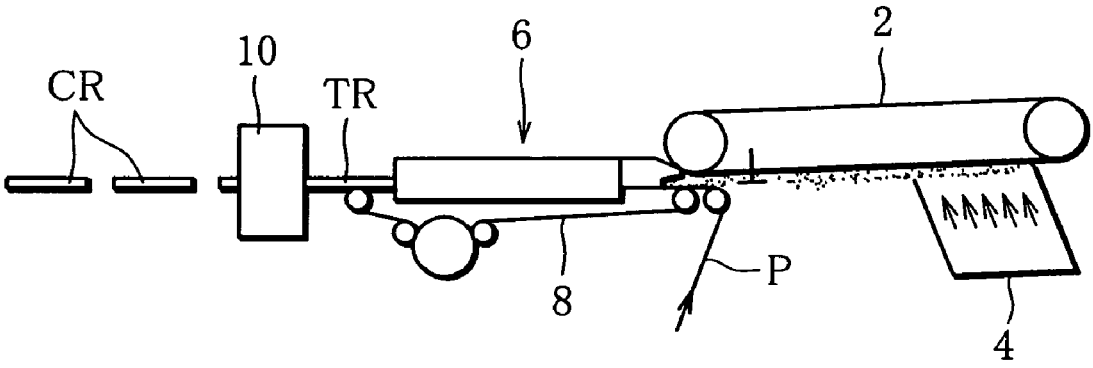
FIG. 1 is a schematic view of a cigarette manufacturing machine.

FIG. 1 schematically illustrates a cigarette manufacturing machine.

The manufacturing machine has an endless tobacco band 2, which comprises a suction belt and travels in one direction. A shredded tobacco supply device 4, described later, is arranged below a right-hand end portion of the tobacco band 2 as viewed in FIG. 1. The supply device 4 supplies shredded tobacco to the lower surface of the tobacco band 2, whereupon the shredded tobacco is attracted by suction to the lower surface of the tobacco band 2 in the form of a layer. As the tobacco band 2 travels, the shredded tobacco layer thus formed on the lower surface of the tobacco band 2 is conveyed to the left as viewed in FIG. 1.

A wrapping section 6 is arranged next to the left-hand end of the tobacco band 2 and includes an endless garniture tape 8. The garniture tape 8 travels in the same direction as the tobacco band 2.

Also, the wrapping section 6 is supplied with a paper web P. The paper web P is fed onto the garniture tape 8 and travels together with the tape 8. At the inlet end of the wrapping section 6, the paper web P receives the shredded tobacco layer from the tobacco band 2. The paper web P and the shredded tobacco layer are then conveyed, together with the garniture tape 8, through the wrapping section 6 toward the outlet end of same.

In the process of conveyance of the paper web P and the shredded tobacco layer, the shredded tobacco layer is continuously wrapped in the paper web P with the aid of the garniture tape 8, thus forming a tobacco rod TR. The tobacco rod TR is continuously delivered from the outlet end of the wrapping section 6. Subsequently, the tobacco rod TR passes through a cutting section 10, where the tobacco rod is cut into individual cigarettes CR. Each cigarette CR has a length twice that of the cigarette of a filter cigarette, for example.

Figure 2:
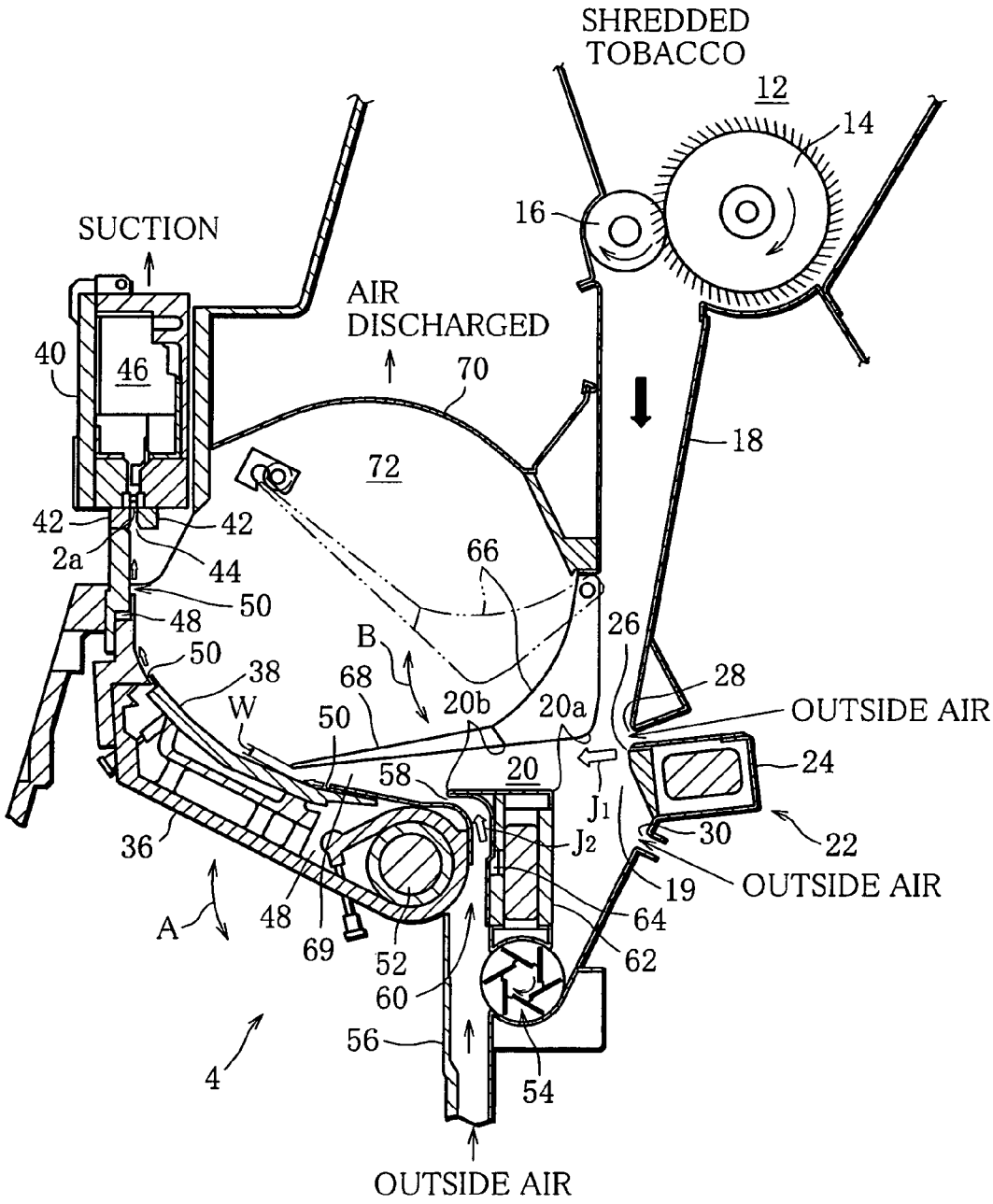
FIG. 2 is a vertical sectional view of a shredded tobacco supply device incorporated in the manufacturing machine of FIG. 1.

FIG. 2 shows part of the aforementioned supply device 4 in detail.

The supply device 4 has a sub-hopper 12 for shredded tobacco. A needle roller 14 and a picker roller 16 are arranged at the lower opening of the sub-hopper 12 and close the lower opening. The needle roller 14 and the picker roller 16 are rotated in opposite directions. As these rollers rotate, the shredded tobacco in the sub-hopper 12 is discharged from between the rollers 14 and 16, and the discharged shredded tobacco is received by a gravity chute 18. The gravity chute 18 extends downward, and accordingly, the shredded tobacco discharged from the sub-hopper 12 falls down through the gravity chute 18.

A main hopper (not shown) for shredded tobacco is arranged in the vicinity of the sub-hopper 12. The main hopper is connected, on one hand, to the sub-hopper through a lift conveyor (not shown) and, on the other hand, to a shredded tobacco distributor through a delivery duct (not shown). The distributor supplies shredded tobacco to the delivery duct, whereupon the shredded tobacco is delivered, together with an air current, through the delivery duct to the main hopper.

As is clear from FIG. 2, the gravity chute 18 has an opening width which gradually decreases, then increases, and again gradually decreases toward a lower end thereof. Namely, the gravity chute 18 has a widened section 19 at an intermediate portion thereof.

A separation throat 20 diverges from the widened section 19 of the gravity chute 18 and extends to the left as viewed in FIG. 2. The separation throat 20 has an inlet 20*a* communicating with the widened section 19 of the gravity chute 18. Also, the gravity chute 18 is provided with a primary separator 22 for emitting an air jet $J_1$ toward the inlet 20*a* of the separation throat 20.

More specifically, the primary separator 22 has a nozzle casing 24 attached to that side wall of the gravity chute 18 which is located opposite the inlet 20*a* of the separation throat 20. The nozzle casing 24 is connected to a compressed air source (not shown) so that compressed air may be supplied from the source to the interior of the nozzle casing 24. Further, the nozzle casing 24 has a built-in jet nozzle 26 opening at one end into the gravity chute 18 and communicating at the other end with the interior of the nozzle casing 24. Consequently, the compressed air supplied to the interior of the nozzle casing 24 is emitted from the opening of the jet nozzle 26 as the air jet $J_1$ indicated by an outline arrow in the figure.

Further, outside air inlet openings 28 and 30 are formed through the side wall of the gravity chute 18 and located above and below the primary separator 22, respectively. When the air jet $J_1$ is emitted from the primary separator 22 into the gravity chute 18, that is, toward the inlet 20*a* of the separation throat 20, outside air is introduced through the outside air inlet openings 28 and 30 into the gravity chute 18.

A fluid bed trough 36 extends from an outlet 20*b* of the separation throat 20, and a ceiling wall 70 is arranged above the fluid bed trough 36. The ceiling wall 70 comprises a mesh screen and connects between the gravity chute 18 and the frame of the supply device so as to enclose a space above the fluid bed trough 36. The ceiling wall 70 and the fluid bed trough 36 cooperate with part of the gravity chute 18 and part of a band casing 40 to define a circular trough chamber 72, which forms part of an air circulation path.

The fluid bed trough 36 has a trough bottom 38 forming the bottom of the trough chamber 72 and extending toward the aforementioned tobacco band 2. More specifically, the trough bottom 38 extends from the outlet 20*b* of the separation throat 20 toward the tobacco band 2 while curving upward, and rises almost upright just below the tobacco band 2.

The endless tobacco band 2 extends through the band casing 40 in such a manner that a lower band section 2*a* thereof extends along the lower surface of the band casing 40. A pair of guide walls 42 are attached to the lower surface of the band casing 40 and protrude downward from the lower surface of the casing 40. The guide walls 42 extend parallel to each other along the lower band section 2*a* and are located on opposite sides of the lower band section 2*a*. Of the two guide walls 42, the outer guide wall 42 meets the upper end of the trough bottom 38. Accordingly, the two guide walls 42 define therebetween a guide passage 44 for the lower band section 2*a*, and the guide passage 44 connects the lower band section 2*a* and the trough bottom 38 to each other.

Further, the band casing 40 defines a suction chamber 46 therein, and a constant suction pressure is supplied to the suction chamber 46. The suction pressure creates a suction air current which flows into the suction chamber 46 from the upper end of the trough bottom 38 through the guide passage 44 and the lower band section 2*a* and which escapes from the ceiling wall of the band casing 40.

The fluid bed trough 36 defines an air chamber 48 therein, and compressed air is supplied to the air chamber 48. The trough bottom 38 of the fluid bed trough 36 is provided with multiple stages of accelerators 50 which are arranged at respective predetermined intervals in a region between the outlet 20*b* of the separation throat 20 and the pair of guide walls 42.

Specifically, each accelerator 50 includes a riser formed on the trough bottom 38, and a nozzle opening formed in the riser. The nozzle opening opens toward the tobacco band 2 and communicates with the air chamber 48 of the fluid bed trough 36. Consequently, air jets indicated by outline arrows in the figure are emitted from the nozzle openings of the respective accelerators 50 toward the tobacco band 2.

The fluid bed trough 36 has one end located close to the separation throat 20 and swingably supported by a shaft 52. Thus, the fluid bed trough 36 is swingable about the shaft 52 in directions indicated by the arrow A in FIG. 2, so that the trough chamber 72 can be opened and closed.

The lower end of the aforementioned gravity chute 18 is connected through a paddle wheel 54 to a reception opening formed at an intermediate position of a separation duct 56. The separation duct 56 extends vertically and opens at an upper open end 58 in the trough bottom 38. The open end 58 is directed toward the tobacco band 2. More specifically, the upper portion of the separation duct 56 is defined between the one end portion of the fluid bed trough 36 and the gravity chute 18, and the open end 58 is formed by a level difference between the lower edge of the outlet 20*b* of the separation throat 20 and the trough bottom 38.

The gravity chute 18 has a side wall connecting between the separation throat 20 and the paddle wheel 54, and this side wall is constituted by a secondary separator 60, that is, a nozzle casing 62 thereof. The nozzle casing 62 is supplied with compressed air and has a jet nozzle 64 arranged therein. The jet nozzle 64 opens into the separation duct 56 and is directed upward, that is, toward the open end 58. Also, the jet nozzle 64 communicates with the interior of the nozzle casing 62. Consequently, compressed air is ejected from the jet nozzle 64 into the separation duct 56 as an air jet $J_2$ indicated by an outline arrow in the figure.

The air jet $J_2$ is discharged from the open end 58 of the separation duct 56 along the trough bottom 38, and the discharge of the air jet creates a rising air current inside the separation duct 56, which air current allows outside air to be introduced into the separation duct 56 from a lower end thereof (not shown).

Further, a movable flap 66 is arranged above the secondary separator 60. The movable flap 66 forms the separation throat 20 in cooperation with the upper surface of the secondary separator 60 and also forms part of the gravity chute 18. Specifically, the movable flap 66 forms the ceiling wall of the separation throat 20 as well as part of the side wall of the gravity chute 18, and in this case, the upper surface of the secondary separator 60 forms the bottom of the separation throat 20.

The movable flap 66 is swingably supported at an upper end thereof by a supporting pin 68. Thus, the movable flap 66 can be swung back and forth about the supporting pin 68, as indicated by the arrow B in FIG. 2.

Also, the movable flap 66 has an extension 68 attached to a lower end thereof. The extension 68 extends toward the trough bottom 38 and covers the open end 58 of the separation duct 56 from above. The extension 68 cooperates with the trough bottom 38 to form a confluent nozzle 69 connecting with the separation throat 20. Specifically, the confluent nozzle 69 has one end connecting with the outlet 20*b* of the separation throat 20 and the other end opening toward the tobacco band 2, and the cross-sectional flow area of the confluent nozzle 69 gradually decreases with distance from the outlet 20*b* of the separation throat 20 along the trough bottom 38.

Further, the lower surface of the extension 68 connects smoothly with the ceiling wall of the separation throat 20 so that the ceiling wall of the separation throat 20 and the lower surface of the extension 68 may extend straight in the direction in which the aforementioned air jet $J_1$ is emitted.

Also, the distal end of the extension 68 is located closer to the tobacco band 2 than that accelerator 50 which is nearest to the open end 58 of the separation duct 56. An opening W (nozzle opening of the air confluent nozzle 69) defined between the distal end of the extension 68 and the trough bottom 38 has a height ranging from 10 to 20 mm.

In the shredded tobacco supply device 4 described above, shredded tobacco is discharged from the sub-hopper 12 into the gravity chute 18. While the thus-discharged shredded tobacco falls down through the gravity chute 18, the air jet $J_1$ and the outside air introduced from the outside air inlet openings 28 and 30 are blown sideways against the shredded tobacco.

As the air jet $J_1$ and the outside air are blown against the shredded tobacco, relatively light shreds in the shredded tobacco are deflected toward the separation throat 20 and introduced through the separation throat 20 to the trough bottom 38. On the other hand, undetected and thus heavy shreds keep falling down through the gravity chute 18 and are discharged into the separation duct 56 through the paddle wheel 54 and the reception opening. Namely, the tobacco shreds falling down through the gravity chute 18 are subjected to primary winnowing by means of the air jet $J_1$ and the introduced outside air, to be separated according to their weights.

The rising air current flowing in the separation duct 56 blows up relatively light shreds, among the heavy shreds discharged into the separation duct 56, to recover shreds, and the thus-recovered shreds are introduced, together with the air jet $J_2$, through the open end 58 of the separation duct 56 to the trough bottom 38. Namely, the heavy shreds discharged to the separation duct 56 are subjected to secondary winnowing by means of the rising air current in the separation duct 56, to be separated according to their weights.

Consequently, only those heavy and thus defective shreds (containing midribs of tobacco leaves) which are outside a prescribed range and not suited for the production of the tobacco rod TR are let fall down the separation duct 56 and delivered from the separation duct 56 to a collection path (not shown).

To the air confluent nozzle 69 are supplied the air jet $J_1$ (including the introduced outside air) flowing from the separation throat 20 and the air jet $J_2$ (including the introduced outside air) flowing from the open end 58 of the separation duct 56, and also the upstream accelerator 50 emits an air jet into the air confluent nozzle 69.

Thus, the three air jets join together inside the air confluent nozzle 69, and in addition, the cross-sectional flow area of the air confluent nozzle 69 gradually decreases with distance from the outlet 20*b* of the separation throat 20 toward the nozzle opening, as stated above. Consequently, the air jets joined together inside the air confluent nozzle are accelerated, forming a strong transport flow forcefully flowing in the air confluent nozzle 69. Such a strong transport flow permits reliable and stable conveyance of the mixture of the light shreds and the recovered shreds, obtained by the primary and the secondary winnowing, through the air confluent nozzle 69 and delivers the shred mixture from the air confluent nozzle 69 toward the tobacco band 2 along the trough bottom 38.

Since the extension 68 extends in the direction of emission of the air jet $J_1$, the air jet $J_1$ smoothly flows along the lower surface of the extension 68 and joins the air jet $J_2$ in layers. Accordingly, the air jets $J_1$ and $J_2$ do not stir up the shred mixture in the air confluent nozzle 69, thus ensuring smooth conveyance of the shred mixture.

After passing through the air confluent nozzle 69, the shred mixture is further conveyed along the trough bottom 38 up to the tobacco band 2, with the aid of the air jets from the accelerators 50, and is attracted to the tobacco band 2 by suction.

The air confluent nozzle 69 produces a strong transport flow therein, as stated above, and it is therefore possible to reduce the flow velocity and flow rate of the air jets emitted from the accelerators 50 located downstream of the air confluent nozzle 69, or to reduce the number of such downstream accelerators 50. Moreover, the flow velocity and flow rate of the air jets $J_1$ and $J_2$ can also be reduced, making it possible to significantly lessen the consumption of energy needed to produce the air jets as a whole.

Also, by reducing the flow velocity and flow rate of the air jets, it is possible to lessen the vaporization of aromatic components from the shred mixture, whereby the flavor and aroma of the shred mixture can be kept.

The flow velocity and flow rate of the air jets $J_1$ and $J_2$ from the primary and secondary separators 22 and 60 and those from the accelerators 50 may alternatively be left the same as in existing devices, in which case the supply device can be remarkably improved in the shred mixture conveyance capability.

Further, the height W of the nozzle opening of the air confluent nozzle 69 from the trough bottom 38 is within the range from 10 to 20 mm. Thus, the air confluent nozzle 69 forms no great resistance to the conveyance of the shred mixture on the trough bottom 38 and instead can control the layer of the shred mixture being conveyed toward the tobacco band 2 to an optimum thickness. As a result, the aforementioned shredded tobacco layer can be satisfactorily formed on the tobacco band 2.

The air jets flowing into the trough chamber 72 return to the circulation path through the ceiling wall, that is, the mesh screen 70.

The present invention is not limited to the foregoing embodiment and may be modified in various ways.

For example, the height W of the nozzle opening of the air confluent nozzle 69 may be suitably set so that the joined air jet flowing from the air confluent nozzle 69 can convey the shred mixture up to the tobacco band 2. In this case, all of the accelerators 50 can be omitted.

Figure 3:
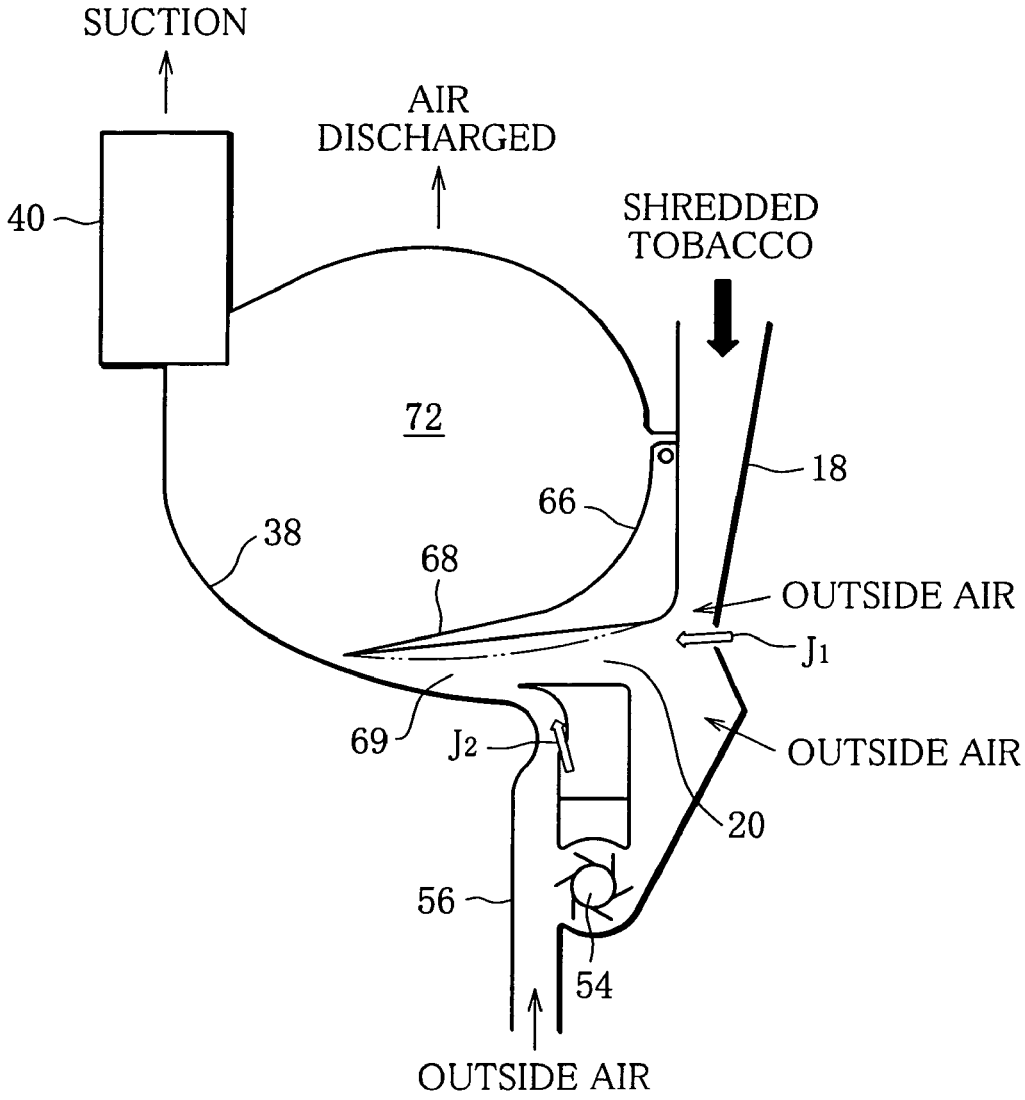
FIG. 3 is a schematic view showing a modification of the supply device.

In the case where the accelerators 50 are omitted, the trough bottom 38 may be formed so as to have a smooth arcuate surface, as shown in FIG. 3, thereby significantly lessening fragmentation of the shred mixture due to collision against the trough bottom 38. Also, the shred mixture is exposed only to the air jets $J_1$ and $J_2$ (containing the introduced outside air) and not to the air jets from the accelerators 50, making it possible to keep the flavor and aroma of the shred mixture.

Further, the ceiling wall of the separation throat 20 and the extension 68 may be formed so that the lower surfaces thereof may be curved in downwardly convex form as a whole, as indicated by the dash-dot-dot line in FIG. 3.

Figure 4:
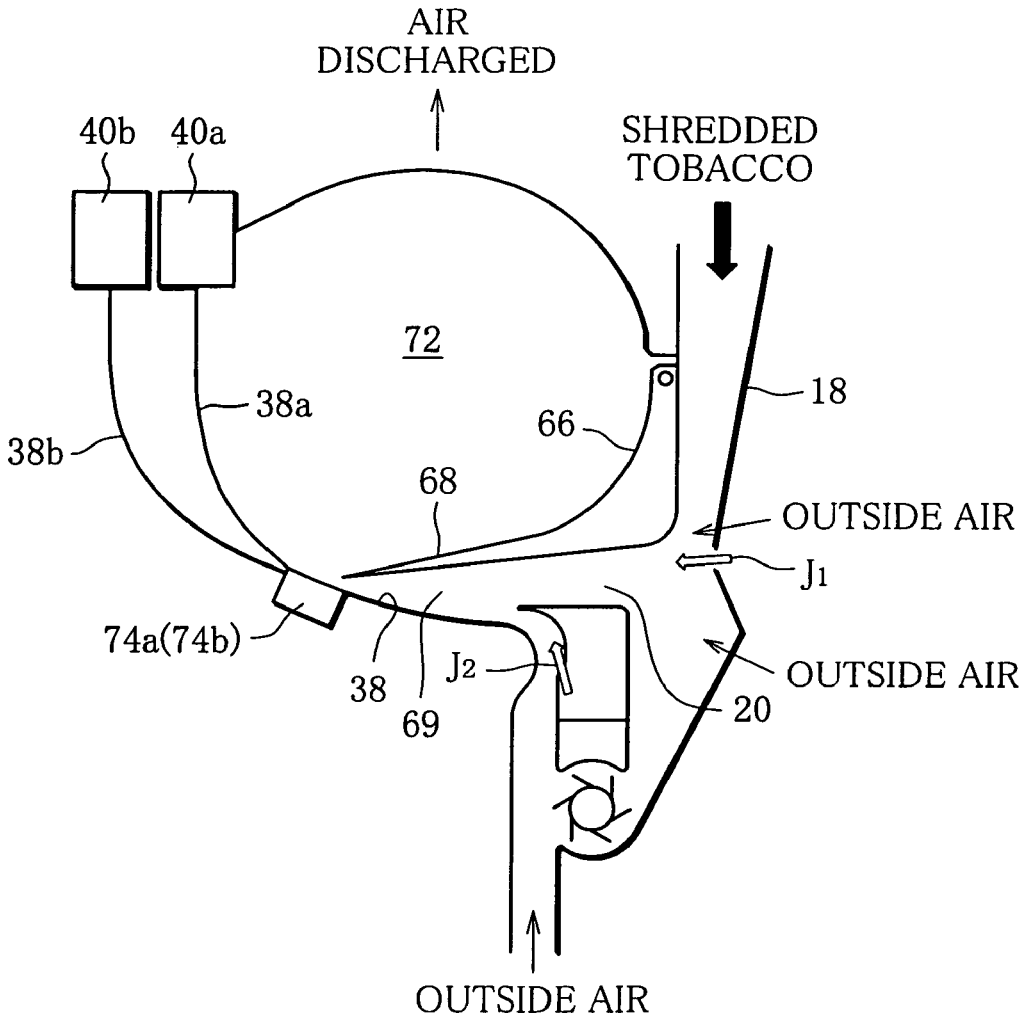
FIG. 4 is a schematic view of a supply device applied to a double track type cigarette manufacturing machine.

As shown in FIG. 4, moreover, the supply device of the present invention is equally applicable to a double track type filter cigarette manufacturing machine.

The double track type manufacturing machine is equipped with a pair of band casings 40*a* and 40*b*. The band casings 40*a* and 40*b* are arranged side by side and have respective tobacco bands 2. In this case, the trough bottom 38 is divided into first and second trough sections 38*a* and 38*b* on the downstream side of the air confluent nozzle 69, and the first and second trough sections 38*a* and 38*b* extend to the tobacco bands 2 of their corresponding band casings 40*a* and 40*b*.

Figure 5:
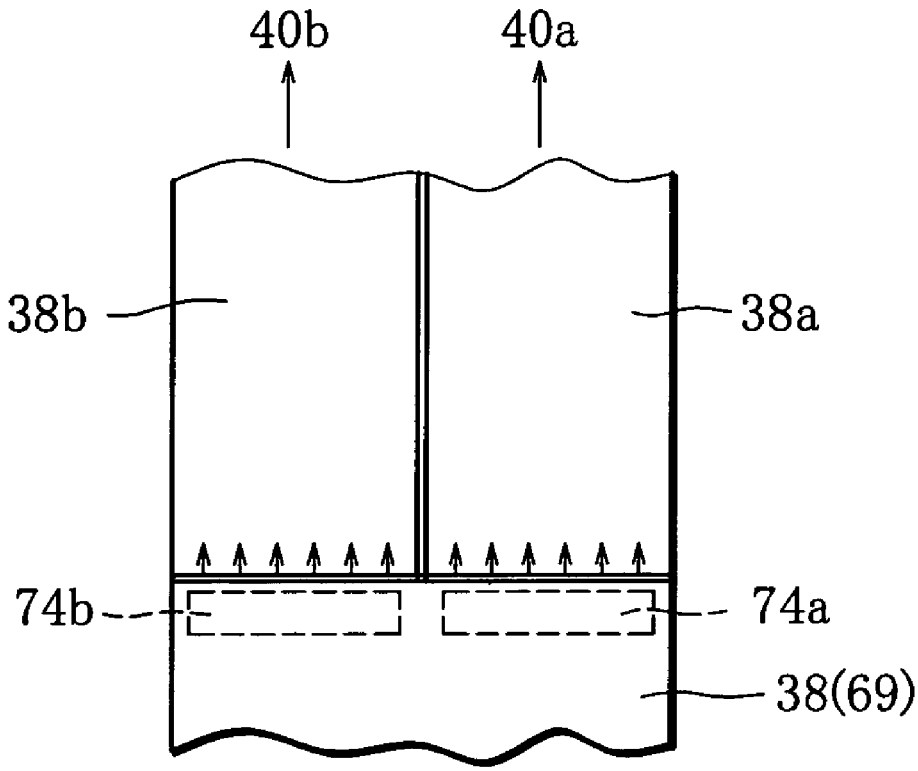
FIG. 5 shows part of the supply device of FIG. 4.

More specifically, as shown in FIG. 5, the first and second trough sections 38*a* and 38*b* are provided with branch accelerators 74*a* and 74*b* at their respective starting ends. The branch accelerators 74*a* and 74*b* emit air jets along the first and second trough sections 38*a* and 38*b*, respectively, to convey the shred mixture to the tobacco bands 2 of their respective band casings 40*a* and 40*b*.

The invention claimed is:

1. A shredded tobacco supply device for a cigarette manufacturing machine, comprising:

a gravity chute through which shredded tobacco supplied thereto is let fall down, said gravity chute having a lower end for discharging the falling shredded tobacco therefrom;

a separation throat diverging sideways from an intermediate portion of said gravity chute and having an inlet opening into said gravity chute and an outlet spaced apart from the inlet in the diverging direction;

a primary separator for separating the shredded tobacco falling down through said gravity chute into light shreds which are introduced into said separation throat, and heavy shreds which are allowed to fall down through said gravity chute, in accordance with weights of the shreds, said primary separator producing a primary air jet traversing an interior of said gravity chute and directed toward the inlet of said separation throat;

a fluid bed trough extending from the outlet of said separation throat to a tobacco band of the cigarette manufacturing machine, said fluid bed trough having a conveyance surface for guiding the light shreds delivered from the outlet of said separation throat toward the tobacco band;

a separation duct extending downward from the conveyance surface, said separation duct having an open end opening in the conveyance surface in the vicinity of the outlet of said separation throat and directed toward the tobacco band, and a reception opening formed at an intermediate position thereof, the reception opening being connected to the lower end of said gravity chute for receiving the heavy shreds from said gravity chute into said separation duct;

a secondary separator for separating the heavy shreds received by said separation duct into recovery shreds which are lifted upward through said separation duct and delivered onto the conveyance surface of said fluid bed trough, and reject shreds which are allowed to fall down through said separation duct, in accordance with weights of the heavy shreds, said secondary separator emitting a secondary air jet from a position of said separation duct upward of the reception opening, the secondary air jet being directed toward the open end and creating a rising current within said separation duct for lifting the recovery shreds upward; and an air confluent nozzle extending from the outlet of said separation throat, said air confluent nozzle having a cross-sectional flow area gradually decreasing with distance from the outlet of said separation throat toward the tobacco band and producing a transport flow by joining together the primary air jet from the outlet of said separation throat and the secondary air jet from the open end of said separation duct, the transport flow causing a shred mixture of the light shreds delivered from the outlet of said separation throat and the recovery shreds delivered from the open end of said separation duct to be conveyed along the conveyance surface of said fluid bed trough toward the tobacco band.

2. The shredded tobacco supply device according to claim 1, wherein said air confluent nozzle has an extension member extending from an upper edge of the outlet of said separation throat, the extension member forming said air confluent nozzle in cooperation with the conveyance surface.

3. The shredded tobacco supply device according to claim 2, wherein said separation throat has a ceiling wall and a bottom surface adjoining the conveyance surface, the extension member extending smoothly from the ceiling wall.

4. The shredded tobacco supply device according to claim 3, wherein the extension member and the ceiling wall extend straight along a direction in which the primary air jet is emitted.

5. The shredded tobacco supply device according to claim 3, wherein the extension member and the ceiling wall are curved in downwardly convex form.

6. The shredded tobacco supply device according to claim 2, wherein said air confluent nozzle has a nozzle outlet at a distal end of the extension member, the nozzle outlet having a height of 10 to 20 mm from the conveyance surface.

7. The shredded tobacco supply device according to claim 2, further comprising a plurality of accelerators provided in said fluid bed trough for accelerating the conveyance of the shred mixture on the conveyance surface toward the tobacco band, said accelerators being arranged at intervals in the direction of conveyance of the shred mixture and each adapted to emit an air jet toward the tobacco band.

8. The shredded tobacco supply device according to claim 7, wherein a most upstream one of said accelerators as viewed in the direction of conveyance of the shred mixture is located inside the said confluent nozzle.

9. The shredded tobacco supply device according to claim 1, wherein the conveyance surface of said fluid bed trough is divided into first and second trough sections on a downstream side of said air confluent nozzle, the first and second trough sections being adapted to supply the shred mixture to respective tobacco bands of a double track type cigarette manufacturing machine.

* * * * *